United States Patent [19]

Kearney

[11] 4,038,027

[45] * July 26, 1977

[54] CELLULOSIC TEXTILE MATERIALS HAVING IMPROVED SOIL RELEASE AND STAIN RESISTANCE PROPERTIES

[75] Inventor: John A. Kearney, Macon, Ga.

[73] Assignee: The Bibb Company, Macon, Ga.

[ * ] Notice: The portion of the term of this patent subsequent to July 29, 1992, has been disclaimed.

[21] Appl. No.: 599,350

[22] Filed: July 28, 1975

Related U.S. Application Data

[63] Continuation-in-part of Ser. No. 318,858, Dec. 27, 1972, Pat. No. 3,897,206.

[51] Int. Cl.[2] ..... D06M 13/20

[52] U.S. Cl. ..... 8/120; 8/116 R; 427/390 B

[58] Field of Search ..... 8/120, 116 R; 427/390

[56] References Cited

U.S. PATENT DOCUMENTS

| | | | |
|---|---|---|---|
| 3,535,308 | 10/1970 | Schaefer et al. | 260/209.5 |
| 3,540,835 | 11/1970 | Marco | 8/115.6 |
| 3,897,206 | 7/1975 | Kearney | 8/120 |

*Primary Examiner*—John Kight, III

*Attorney, Agent, or Firm*—Cushman, Darby & Cushman

[57] ABSTRACT

Soil release and stain resistance properties of cellulosic textile materials are improved by reacting a cellulosic textile material with a water-soluble synthetic polymer acid or anhydride. After impregnating the cellulosic material with a synthetic polymer acid or anhydride and an esterification catalyst, the impregnated material is dried and subsequently cured in order that the polymer may react with the cellulosic material in the presence of the esterification catalyst. The material is then washed to yield the finished product. This procedure is applicable to fibers, yarns and manufactured cloths of various hydroxyl-containing polymers such as cotton, cotton-containing materials and blends of cellulosic materials with various synthetics such as polyesters.

15 Claims, No Drawings

CELLULOSIC TEXTILE MATERIALS HAVING IMPROVED SOIL RELEASE AND STAIN RESISTANCE PROPERTIES

BACKGROUND OF THE INVENTION

This application is a continuation-in-part of my copending application Ser. No. 318,858, filed Dec. 27, 1972 which is to issue July 29, 1975 as U.S. Pat. No. 3,897,206.

The present invention is directed to an improved process for the treatment for fibrous materials as described in Ser. No. 318,858. More particularly, it relates to a method of impregnating textile fabrics, fibers and yarns with a water-soluble synthetic polymer acid or anhydride so as to impart soil release and stain resistant properties thereto.

Permanent press fabrics are well known in the art, and the textile industry is constantly striving to improve the properties thereof. One of the main considerations in this regard is to provide textile fabrics which are resistant to stains and soil, especially of an oily nature. Such properties are particularly desired in cellulosic-type materials, as best exemplified by cotton.

For a chemical point of view, it is believed that cotton is predominantly cellulose. The generally accepted concept of the chemical constitution of cellulose is that it comprises a natural high polymer with an anhydride of glucose as its basic building block or unit. Aside from natural changes and reactions which alter the cellulose structure to some degree, i.e., esterification with natural acids, hydrogen bonding, etc., the basic cellulose chain molecule occuring in cotton may be depicted as follows:

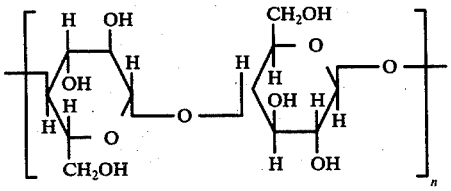

Examination of this structure shows one primary hydroxyl group in the 6-position and two secondary hydroxyl groups in the 2- and 3-positions. In addition, the end groups in each chain contain a secondary hydroxyl group in the 4-position. The latter hydroxyl groups react typically as usual hydroxyl groups, although they are subject to structural conditions, steric hindrance and the like.

As a result of a great amount of research which has been carried out on cotton, it has ben found that the hydroxyl groups do, in fact, react typically, but, depending upon the reaction conditions, the polymer chain is also attacked and changed drastically. This is clearly illustrated in connection with the production of rayon and in the so-called "tendering" of cotton cloth when it is subjected to treatment with, for example, maleic acic. As is well known in the art, "tendering" is the reduction in tensile strength of a fibrous yarn or cloth resulting from the breakdown of the links in the polymer chain.

Various materials have been added to cellulosic fabrics to improve the properties thereof, such as creaseresistance, resistance to shrinkage, light fastness, soil resistance and the like. Varying degrees of success have been obtained in such procedures. However, it is important that the impregnant used does not reduce the tensile strength of the material or adversely affect any of the important properties thereof.

Marco in U.S. Pat. No. 3,540,835 discloses a method of improving the soil release characteristics of cellulosic materials by applying thereto a carboxylic acid group containing copolymer. The textile is previously treated with an aminoplast resin. The acid polymer employed by Marco must be capable of forming a film around the fibers that constitute the textile material. According to this prior art process, the anhydro-glucose molecules in the textile materials which are treated remain chemically substantially unmodified and the formation of a film by the acid polymer around the textile fibers provides soil release properties thereto. In contrast thereto, the ethylene-maleic anhydride or ethylene-maleic acid copolymers employed in Ser. No. 318,858 react with the cellulosic materials to essentially eliminate the polar conditions which are conducive to fatty soil retention. In Ser. No. 318,858 it was essential for a reaction to occur between the acid or anhydride group in the impregnating polymer and the cellulosic material in order to eliminate unwanted polar sites in the cellulosic materials.

One of the primary objects of the present invention is to provide cellulosic materials having an improved soil release and a stain-resistance property.

Another object of the invention is to provide a method for imparting soil resistance to textile materials which may be carried out efficiently and effectively in an economical manner without adversely affecting the properties or characteristics thereof using a wide variety of economical soil release agents.

A further object of the invention is to provide textile materials having various desirable excellent properties, including good hand, soil release and stain resistant qualities.

These and other objects and advantages of the present invention will become apparent to those skilled in the art from a consideration of the following specification and claims.

SUMMARY OF THE INVENTION

In accordance with the present invention, it has been found that the above objectives and others may be attained by impregnating cellulosic-type materials with a water-soluble synthetic polymer acid or anhydride. In Serial No. 318,858 I describe treatment of cellulosic materials with ethylene maleic anhydride copolymers or ethylene maleic acid copolymers. I have now found that water-soluble synthetic acid and anhydride polymers (and copolymers) can impart soil release properties to cellulosic textile materials when reacted with such materials in the presence of an esterification catalyst. Basically, this invention involves the esterification reaction of the hydroxyl groups of the cellulose chain and the acid groups of the water-soluble synthetic polymer acid or anhydride. I have further found that subsequent to curing the impregnated textile material, it is essential to subject the material to a wash treatment to remove excess unreacted polymer, thereby removing unwanted polar groups, providing the material with acceptable hand qualities.

The water-soluble synthetic acid polymers (or copolymers) and corresponding anhydrides found suitable according to the present invention can be prepared from any polymerizable organic acid having reactive points of unsaturation. Such soil release polymers and copolymers are well known in the art and are described in U.S. Pat. No. 3,540,835, the contents of which are incorporated herein by reference. Exemplary of such suitable soil release polymers include the polymerization products of: ethyl acrylate: acrylic acid; ethyl acrylate: acrylic acid: acrylamide; butyl acrylate: acrylic acid; ethyl acrylate: methacrylic acid; ethyl acrylate: itaconic acid; methyl methacrylate: acrylic acid 2-ethyl hexyl acrylate: acrylic acid; acrylamide: acrylic acid butyl acrylate: acrylic acid: acrylamide; ethyl acrylate: acrylic acid: N-methylol acrylamide; ethyl acrylate: acrylic acid; styrene; ethyl acrylate: acrylic acid: hydroxy propyl methacrylate; ethyl acrylate: acrylic acid: divinyl benzene; ethyl acrylate: acrylic acid: allyl acrylamide; ethyl acrylate: acrylic acid: glycidyl acrylate; ethyl acrylate: itaconic acid; ethyl acrylate; sodium styrene sulfonate; ethyl acrylate: crotonic acid; styrene: acrylic acid; ethyl acrylate: acrylic acid: hydroxy ethyl methacrylate; hydroxy ethyl methacrylate: acrylic acid: acrylamide; butyl acrylate: ethyl acrylate: acrylic acid; and the like.

Of particular interest are water-soluble copolymers having the following typical recurring unit in the polymer chain:

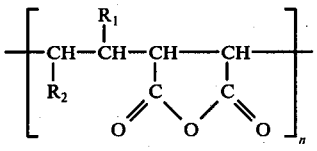

wherein $R_1$ is hydrogen or methoxy;

$R_2$ is hydrogen or an alkyl of 1 to 4 carbons; and provided $R_1$ and $R_2$ are not simultaneously hydrogen and when $R_1$ is methoxy, $R_2$ is hydrogen.

The polymer compounds of the type wherein $R_1$ is methoxy and $R_2$ is hydrogen are commercially available and are marketed by GAF Corporation under the trademark GANTREZ. Such polymers are prepared by reacting methyl vinyl ether with maleic anhydride. Although the above structure shows an anhydride linkage in the chain, it is also quite possible to produce the corresponding diacid derivative thereof. These copolymers may be utilized in the present invention in a wide range of molecular weights, so long as they are water-soluble.

Copolymers according to the above structure wherein $R_1$ and H and $R_2$ is alkyl may be prepared by polymerizing (e.g. alkyl of 4 carbons) hexene-1 /and maleic anhydride. Such a polyanhydride resin is available from Gulf Oil Chemicals Company and is known as PA-6.

Preferred copolymers according to the present invention are linear and have a molecular weight generally of from about 1000 to about 100,000. The polymers must dissolve in hot or cold water, but may also be soluble in many organic solvents. The viscosity of the polymer solutions is not critical and is only limited by the necessity that it must be sufficiently low for impregnation of the textile materials in connection with the present invention.

The procedure of the present invention generally comprises padding of a solution of the water-soluble synthetic acid polymer onto a cloth, yarn or fiber, drying and curing the padded cloth and subsequently washing. From a practical point of view, the copolymer is usually in water to give an aqueous impregnating solution. In this case, the polyanhydride structure dissolves through hydrolysis to give the acid form which is highly soluble in water. An organic solvent solution thereof may also be employed for the padding step in this process. Polar organic solvents such as lower alcohols, for example, methanol, ethanol, propanol, or butanol, may be used advantageously as the organic solvent. It is also quite possible to apply the solution of soil release polymer to the textile material by means of a bath or by spraying. Typical esterification catalysts, such as p-toluene sulfonic acid, methyl sulfonic acid, dodecyl benzene sulfonic acid and dilute sulfuric acid are employed to carry out the reaction.

Drying of the material is conducted for approximately thirty seconds to one hour, depending upon the temperature and type of cloth or material treated. The temperature used during the drying step ranges from air-drying at room temperature (70°–95° F.) to about 300° F. Usually, the time and temperature are inverse functions of each other.

To insure sufficient esterification between the free hydroxyl groups of the cellulosic textile material and the acid groups of the soil release polymer, the dried impregnated material is cured at a temperature in the range of generally from about 250° F. to about 410° F. and for a period of time sufficient to react the soil release polymer with the hydroxyl groups of the textile material (at least 15 seconds). Generally a period from about 15 seconds to 5 minutes is sufficient. The time and temperature parameters are usually inverse functions of each other.

I have found it essential to employ an after-wash step to provide materials having a good hand. Washing will remove excess unreacted and undesirable matter from the material. Since the basic premise of the invention is to remove or drastically reduce the polarity, and more particularly the surface polarity of the textile material (the polarity enhancing soil retention) it is essential that the surface of the textile material be relatively free of contaminants, especially of a polar nature. Thus, the textile material should be relatively clean. Detergent solutions of from 0.25 to 3% by weight containing added soda ash from 0.25 – 2% by weight have proved satisfactory. A preferred treatment involves washing with a solution containing about 1% detergent (e.g. TIDE) and 0.5% soda ash followed by a thorough rinse of the material.

It is, of course, quite possible to include other treatments of the cloth or fibrous material in conjunction with the procedure of the present invention, including softening or hand improvement methods, and treatments to provide better finish, appearance, etc.

As an example of such a separate treatment, good results have been obtained by first treating the material to impart wrinkle resistance thereto by techniques known in the art and, then achieving the soil release properties in accordance with the present invention by the impregnation and treatment with the ethylene-maleic anhydride copolymers. In the case of pretreatment (i.e. the application of a perma-press resin, the treatment is not necessarily hermful to the soil release treatment so long as, in the subsequent soil release treatment, the polycarboxylic soil release moieties contain enough carboxylic groups to "deactivate" the polarity present on the surface of the textile material. As noted above, the application of the synthetic water-soluble anhydride or acid copolymers is particularly beneficial in conjunction with the application of a permanent press impregnant, or in separate treatment steps, to provide textile materials having excellent stain and soil resistance as well as permanent press properties.

The present invention is applicable to cellulose-containing materials, whether in the form of a manufactured cloth, fibers, yarn and the like. Fabrics made of cotton or blends of cotton and polyesters, for example, containing 50 of cotton and 50% of polyester, have been successfully treated in accordance with this invention. Moreover, the impregnation with the synthetic water-soluble anhydride or acid copolymers for obtaining soil release properties may be used with any blends containing cotton, rayon or other celluloics, regardless of the synthetic portion of the blend as well as with snythetic textile materials which contain free hydroxyl groups in their structure. So long as the material to be treated has such free hydroxyl groups, the present invention can be used to impart the desired properties thereto.

The synthetic water-soluble anhydride or acid copolymers are used in the impregnating solutions or baths in a concentration of generally from about 2 to 10% by weight and, as noted above, in varying molecular weights from relatively short chain lengths to high molecular weights. The only limiting factor in this regard appears to be the practical application of the resin to the material to be treated from the point of view of viscosity of the impregnating solution.

EXAMPLES OF THE INVENTION

The following examples are given merely as illustrative of the present invention and are not to be considered as limiting. Unless otherwise noted, the percentages therein and throughout the application are by weight.

EXAMPLE 1

The following aqueous solutions were prepared:

| | |
|---|---|
| **Solution A** | |
| Water | 277.5 grams |
| GANTREZ AN-119 | 21.0 grams |
| p-toluene sulfonic acid | 1.5 grams |
| **Solution B** | |
| Water | 284.4 grams |
| GANTREZ AN-119 | 15.0 grams |
| p-toluene sulfonic acid | 0.6 grams |
| **Solution C** | |
| Water | 227.5 grams |
| GANTREZ AN-139 | 21.0 grams |
| p-toluene sulfonic acid | 1.5 grams |

EXAMPLE 2

Three types of cloth swatches were prepared, each swatch being 12 × 18 inches in dimension.

Type I — 100% cotton muslin cloth

Type II — 50/50 polyester/cotton muslin blend

Type III — 50/50 polyester/cotton percale blend

Prior to further treatment and testing each swatch was treated with a modified urea-formaldehyde perma-press resin (Kaurit 6020) and dried at 280° F. for 1.5 minutes.

EXAMPLE 3

Solution A prepared according to Example 1 was padded onto three swatches of cloth (Types I, II and III of Example 2) to a wet pick up of 70% at room temperature, dried at 250° F. for 2 minutes, and reacted (i.e. cured) at 375° F for 20 seconds. Each swatch was then subjected to a treatment with a 2% detergent (TIDE) and 0.5% soda ash wash solution, thoroughly rinsed and dried. The swatches so treated were stained with Nujol, Wesson Oil, butter and used motor oil, and subjected to wash and dry cycle testing and completed over 25 cycles without failure.

EXAMPLE 4

The procedure according to Example 3 was carried out except that a padding solution B prepared as in Example 1 was employed. Subsequent staining and testing of the swatches indicated excellent soil release properties were imparted thereto.

EXAMPLE 5

In like manner to Example 3, the three swatch types were treated with Solution C of Example 1. The treated swatches exhibited excellent soil release properties.

EXAMPLE 6

A suitable impregnating solution for imparting soil release to the swatches of Example 2 may be prepared from the following ingredients:

| | | |
|---|---|---|
| Copolymer of ethyl acrylate and acrylic acid (50/50) 10% solution | 80 | grams |
| Dodecyl Benzene Sulphonic Acid | 0.05 | grams |
| Triton X-100 | 0.1 | grams |
| Water | 10.0 | grams |

The padding solution can be employed in the manner as described in Example 3.

In a similar manner,various cotton and cotton-containing materials, fibers and yarns may be treated with impregnating solutions containing synthetic water-soluble anhydride and acid copolymers to obtain materials having an excellent resistance to soil, particularly with regard to oily stains and the like, and which have a good hand and other desirable properties. While various modifications may be used in the specific procedures employed within the skill and knowledge of the art, depending upon the material being treated and the desired end properties thereof the basic feature of obtaining good soil resistance by impregnation with a water-soluble anhydride or acid copolymer in connection with this invention remains the same.

Furthermore, the present invention may comprise, consist of, or consist essentially of the hereinbefore recited compositions and steps.

The invention being thus described, it will be obvious that the same may be varied further in many ways. Such variations are not to be regarded as a departure from the spirit and scope of the invention, and all such modifications as may be apparent to those skilled in the art are intended to be included herein.

What is claimed is:

1. A process for imparting improved soil release and stain resistance properties to cellulosic textile materials which comprises:

a. impregnating a cellulose-containing textile material with a solution of a water-soluble synthetic polymer acid or anhydride and an esterification catalyst said polymer having the recurring unit:

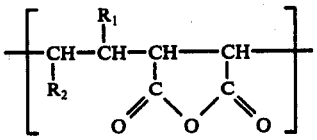

wherein $R_1$ is hydrogen or methoxy;

$R_2$ is hydrogen or an alkyl of 1 to 4 carbons; and provided $R_1$ and $R_2$ are not simultaneously hydrogen and when $R_1$ is methoxy, $R_2$ is hydrogen;

b. drying the impregnated material at from room temperature to about 300° F;

c. curing the dryed impregnated material at a temperature of from about 250° F to about 410° F for a period of at least 15 seconds and sufficient to react said polymer with said cellulose-containing textile material; and d. washing the cured material to remove excess unreacted polymer. --

2. The process of claim 1 wherein said textile material is cotton.

3. The process of claim 1 wherein said textile material is a blend containing cotton or rayon.

4. The process of claim 1 wherein said textile material is a blend containing cotton and a polyester.

5. The process of claim 1 wherein said textile material is in the form of a cloth or sheeting.

6. The process of claim 1, wherein textile material is in the form of a fiber.

7. The process of claim 1 wherein said textile material is in the form of a yarn.

8. The process of claim 1 wherein the drying step is conducted for about 30 seconds to about 1 hour.

9. The process of claim 1 wherein the curing step is conducted for about 15 seconds to about 5 minutes.

10. The process of claim 1 wherein said copolymer has a molecular weight of about 1000 to about 100,000.

11. The process of claim 1 wherein a solution having a concentration of about 2% to 10% by weight of said copolymer is applied to the textile material.

12. The process of claim 1 wherein an aqueous solution of said copolymer is applied to the textile material.

13. A process for imparting improved soil release and stain resistance properties to cellulosic textile materials which comprises:

a. impregnating a cellulose containing textile material with a solution of a water-soluble synthetic copolymer of methyl vinyl ether and maleic acid or anhydride in the presence of an esterification catalyst;

b. drying the impregnated material at from room temperature to about300° F;

c. curing the dryed impregnated material at a temperature of from about 250° F to about 410° F for a period of time sufficient to react said copolymer with said textile material; and d. washing the cured material to remove excess unreacted polymer.

14. The process according to claim 13 wherein said textile material is cotton or a blend thereof.

15. The process according to claim 14 wherein said copolymer has a molecular weight of from 1000 to 100,000.

* * * * *